US006961983B1

(12) United States Patent
Heck et al.

(10) Patent No.: US 6,961,983 B1
(45) Date of Patent: Nov. 8, 2005

(54) TOOLING FOR RIVET GUN

(75) Inventors: Joel J. Heck, Mulvane, KS (US); Mark W. Palmer, Peru, KS (US); Earl V. Long, Wichita, KS (US); Richard Gonzalez, Wichita, KS (US)

(73) Assignee: Cessna Aircraft Company, Wichita, KS (US)

( * ) Notice: Subject to any disclaimer, the term of this patent is extended or adjusted under 35 U.S.C. 154(b) by 0 days.

(21) Appl. No.: 10/888,232

(22) Filed: Jul. 12, 2004

Related U.S. Application Data

(62) Division of application No. 10/224,133, filed on Aug. 20, 2002, now Pat. No. 6,820,319.

(51) Int. Cl.[7] ..... B25B 27/14
(52) U.S. Cl. ..... 29/281.1; 269/290; 269/909
(58) Field of Search ..... 29/897.2, 524.1, 29/525.06, 525.07, 243.53, 243.54, 281.1; 173/135, 94, 15; 72/457; 269/909, 290

(56) References Cited

U.S. PATENT DOCUMENTS 2,496,330 A * 2/1950 Brown ..... 29/243.53
4,039,034 A * 8/1977 Wagner ..... 173/137
4,192,389 A * 3/1980 Raman ..... 173/15
4,218,911 A * 8/1980 Johnston ..... 72/479
4,310,964 A * 1/1982 Murphy ..... 29/469
4,885,836 A * 12/1989 Bonomi et al. ..... 29/524.1
4,894,903 A * 1/1990 Woods ..... 29/448
4,967,947 A * 11/1990 Sarh ..... 227/52
5,199,147 A * 4/1993 Whiteside ..... 29/281.1
5,560,102 A * 10/1996 Micale et al. ..... 29/897.2
5,687,463 A * 11/1997 Michalewski et al. ... 29/243.53
5,896,637 A * 4/1999 Sarh ..... 29/34 B
6,134,940 A * 10/2000 Banks et al. ..... 72/476

* cited by examiner

*Primary Examiner*—David P. Bryant
(74) *Attorney, Agent, or Firm*—Edward L. Brown, Jr.

(57) ABSTRACT

Method and apparatus of back riveting construction for sections of aircraft structure utilizing the flush riveting wherein the back bar tooling for all the rivets in the entire section is a single piece of stationary tooling which conforms to the exterior shape of the aircraft section. The rivet gun is a single impact pneumatic gun with a rivet driving hammer which is offset from the axis of the gun's piston and impact pin to upset rivet under C-channel flanges.

2 Claims, 5 Drawing Sheets

TOOLING FOR RIVET GUN

This application is a divisional of U.S. patent application Ser. No. 10/224,133, filed Aug. 20, 2002, now U.S. Pat. No. 6,820,319.

The present invention relates to an apparatus and method for installing rivets in aircraft structures and more particularly to a hand-held single impact rivet gun used for back riveting in conjunction with back bar tooling.

BACKGROUND OF THE INVENTION

Structural joining processes used for aircraft airframe skin structure basically are either bonded or riveted. Aside from other engineering and manufacturing factors used for the selection of the appropriate joining process, bonded structure has superior aerodynamic qualities while riveted structure costs less to produce. A need for a joining process which is aerodynamically smooth and inexpensive as riveted structure has become a general goal in aircraft design. Devising a riveting process which can produce the smooth appearance of a bonded structure would satisfy both the esthetics, aerodynamics and manufacturing costs requirements. A riveting method to fulfill these needs is one which back drives the shank of the rivet on the inside surface of the aircraft structure so there are no protruding rivet heads on the exterior surface, while the head of the rivet is set in a countersunk hole so as to provide a flush and smooth exterior surface.

The standard riveting techniques used today involve one person holding the rivet with a bucking bar against the shank of the rivet while a second person with a rivet gun upsets the rivet on the exterior surface which sometimes deforms the sheet metal skin. Conventional rivet guns apply rapid impact strikes to the rivet head which sometimes overdrives the rivet causing a deformation to the skin. Single impact rivet guns can be accurately adjusted so the rivet is not over or under driven and there is no possibility of deforming the aircraft skin. Single impact rivet guns are obviously faster than the conventional rivet guns and have more precise control in upsetting the rivet.

The concept of a single impact rivet gun has been around for at least two decades, as illustrated in U.S. Pat. No. 4,039,034 to Wagner and U.S. Pat. No. 4,192,389 to Raman. In the first patent listed, the rivet gun is manually held while in the second patent the rivet gun is mounted in an overall structure which also holds the sections being riveted and the bucking bar on the opposite side of the rivet. Conventional riveting techniques involve a hand-held rivet gun with a bucking bar held on the opposite end of the rivet normally by a second person. The concept of back riveting, wherein the shank of the rivet is on the inside of the aircraft structure rather than the outside, is old as taught in U.S. Pat. No. 4,007,540 to Tyree and U.S. Pat. No. 2,312,554 to Jacques.

The concept of a single person riveting operation is generally old in the art, as taught by U.S. Pat. No. 2,559,248 to Harcourt, U.S. Pat. No. 4,967,947 to Sarh, U.S. Pat. No. 4,662,556 to Gidlund, and U.S. Pat. No. 4,759,109 to Mason et al. All of the last four mentioned patents teach a machine which holds the section of the aircraft being riveted as well as the backing bar device and the riveting gun in an automated unitary structure wherein the backing member moves with the rivet gun across the surface of the section being riveted. U.S. Pat. No. 2,312,554 to Jacques, previously mentioned, also teaches a single person riveting apparatus which again is a unitary structure like the above-mentioned four patents. In the above-mentioned patent to Sarh the bucking component and the riveting component are both mounted on a universal base wherein the bucking unit and the riveting unit are computer controlled for three axis movement in unison.

The concept of an offset rivet gun whereby the driving hammer for the rivet is offset from the axis of the piston and impact pin is taught in the above-mentioned patent to Jacques; however, it is not hand-held nor is it used to drive a rivet under an extending flange of a C-channel, as done in the present invention.

SUMMARY OF THE INVENTION

The rivet gun of the present invention is a hand-held pneumatic gun which back drives the rivets against a solid tooling surface having an identical shape of the aircraft section being fabricated. This process replaces the hand-held bucking bar for each rivet with a stationary tooling surface which provides a backing bar for all of the rivets within the section being fabricated.

Since the single stroke of the rivet gun is carefully limited by a stop, it upsets the shank of the rivet the precise amount necessary to swell the shank and upset the end of the shank to form a head and tightly contain the two or more sheets being joined. Driving the rivet with one controlled hit instead of several also provides a speed advantage over a traditional riveting and also greatly increases the exact amount of upset of the rivet. The sheet clamp up force can also be controlled with the present rivet gun in light of the built-in spring which requires the riveter to push the rivet gun against the rivet until the spring is fully compressed. Once the spring is fully compressed the trigger automatically unlocks and the rivet gun is armed and ready to fire. The spring compression that is generated clamps both the sheets being riveted together and reduces the possibility of a non-shear condition existing between the sheets. The actual rivet gun of the present invention is very similar to a nail gun used in house construction which performs the same basic task as a single impact rivet gun only with more stroke of the impact pin.

The principal object of the present invention is to provide a single person riveting method which utilizes a single impact rivet gun for back riveting against a fixed tooling surface.

A further object of the present invention is to provide a rivet gun having an offset driving hammer for reaching under the flange of a C-channel.

Another object of the present is to provide a single piece of stationary back bar tooling for backing all of the rivets in a section of aircraft being constructed.

Another object of the present invention is to provide a riveting technique which leaves the exterior aircraft surface smooth with no deformation of the skin and the rivets not visible.

Another object of the present invention is to provide a back riveting gun which precisely upsets all of the rivets so as to provide a maximum strength connection.

Further objects and advantages will be pointed out or will become evident in the following detailed description, claims and the accompanying drawings.

DESCRIPTION OF THE PREFERRED EMBODIMENT

Figure 1:
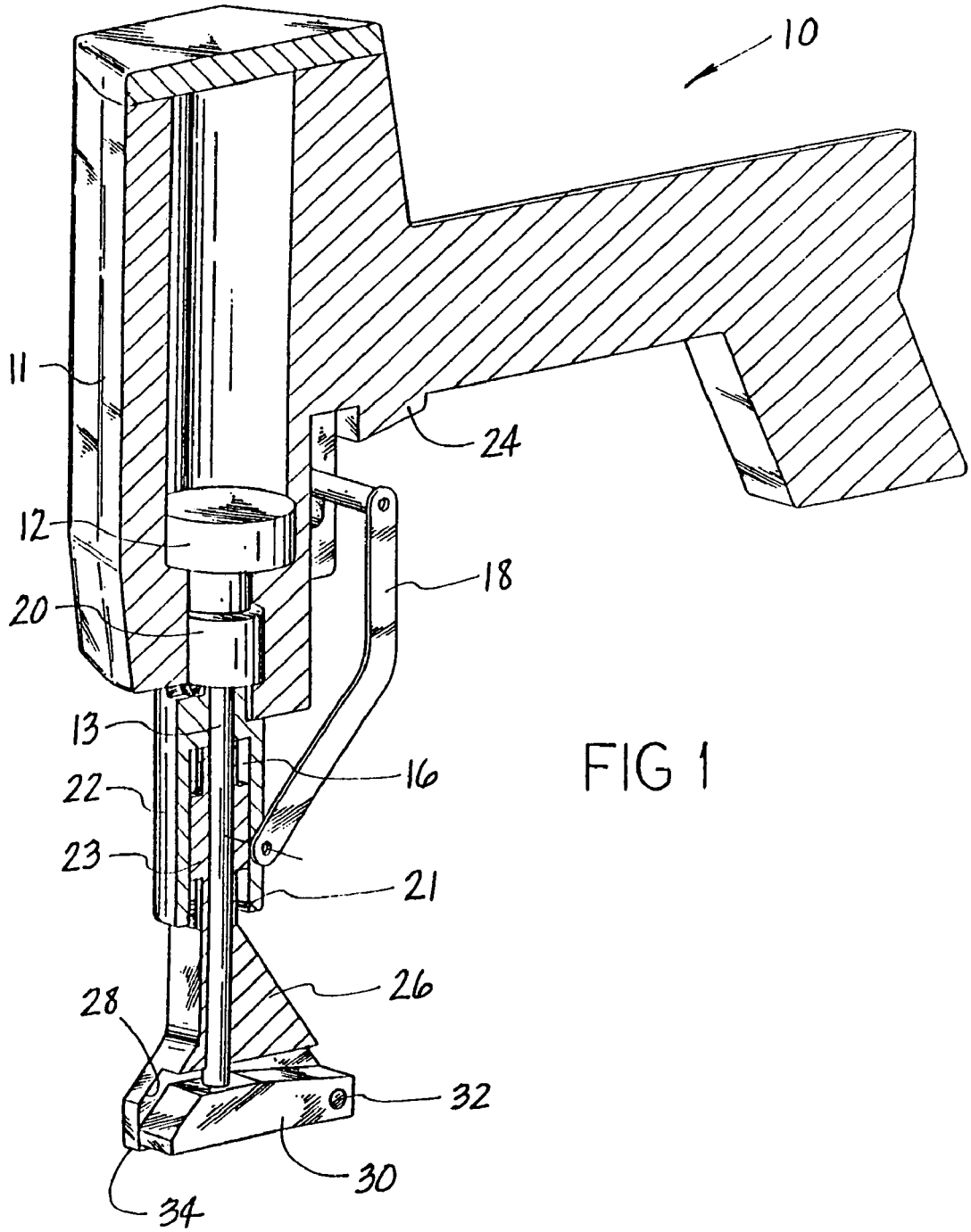
FIG. 1 is an isometric view of the riveting gun of the present invention with portions broken away to see the principal parts of the gun.
Figure 2:
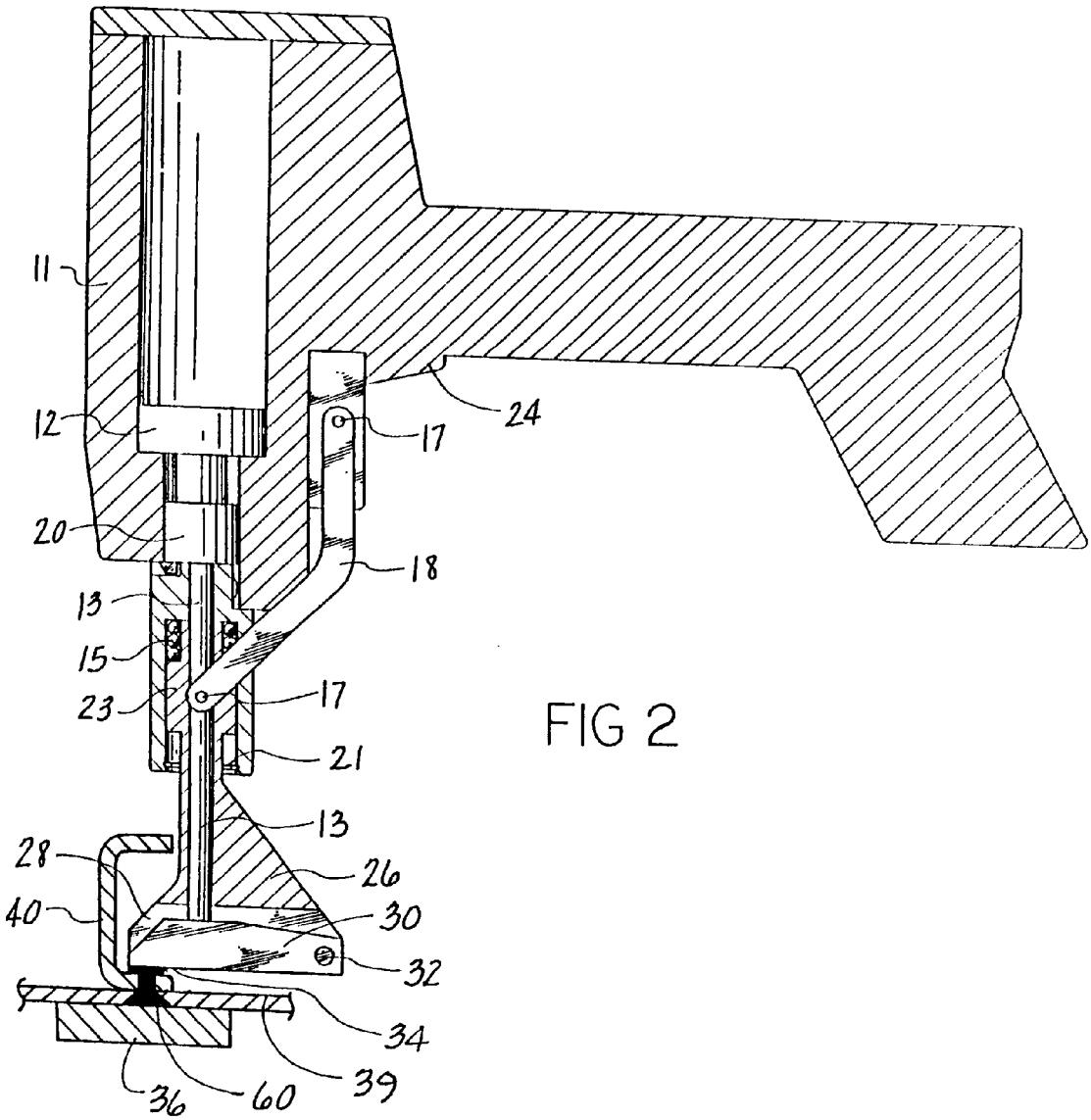
FIG. 2 is a side elevational view of the rivet gun in place on a C-channel with the rivet offset against stationary tooling 36.
Figure 3:
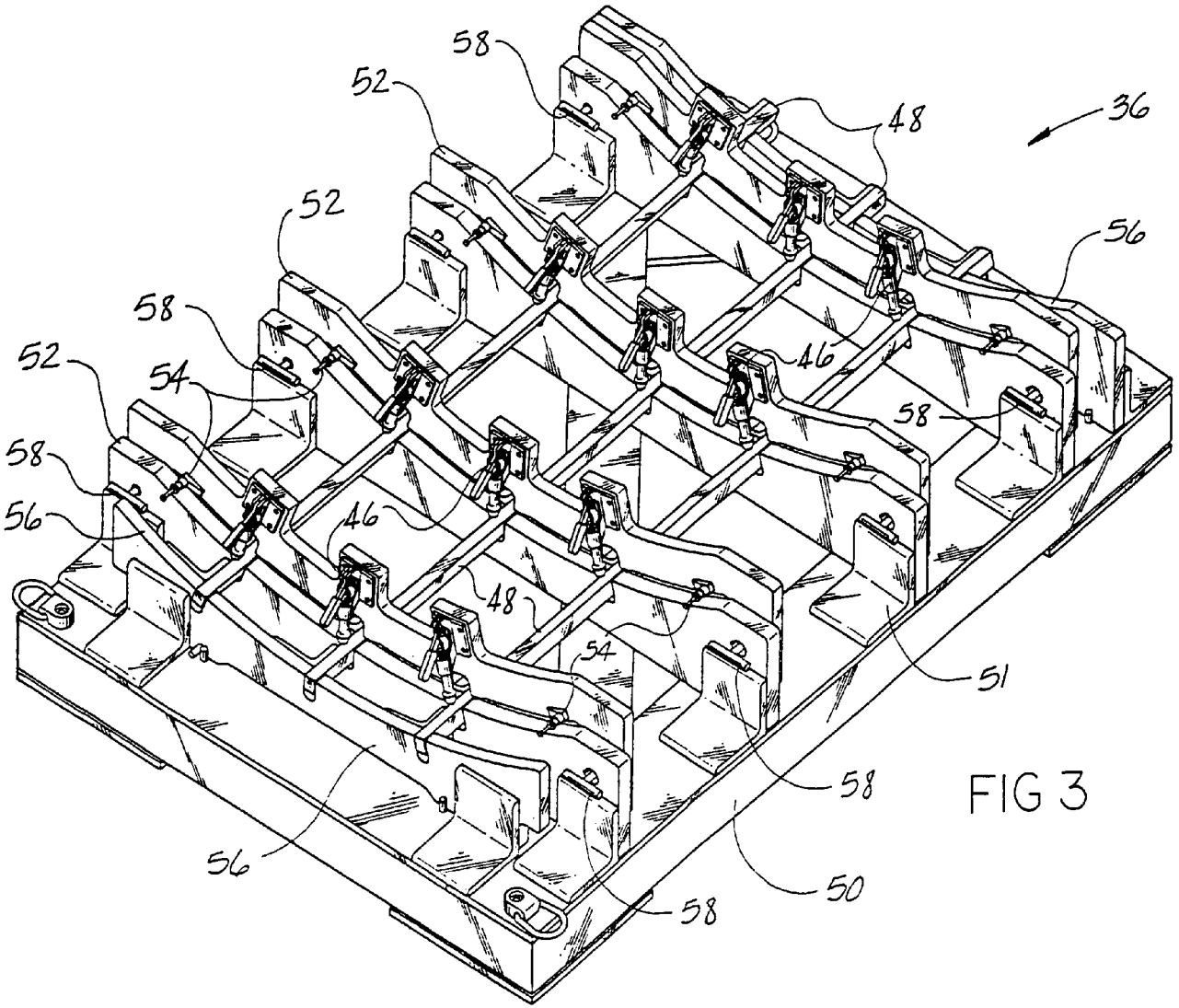
FIG. 3 is a perspective view of the fixed tooling used in conjunction with the rivet gun.
Figure 4:
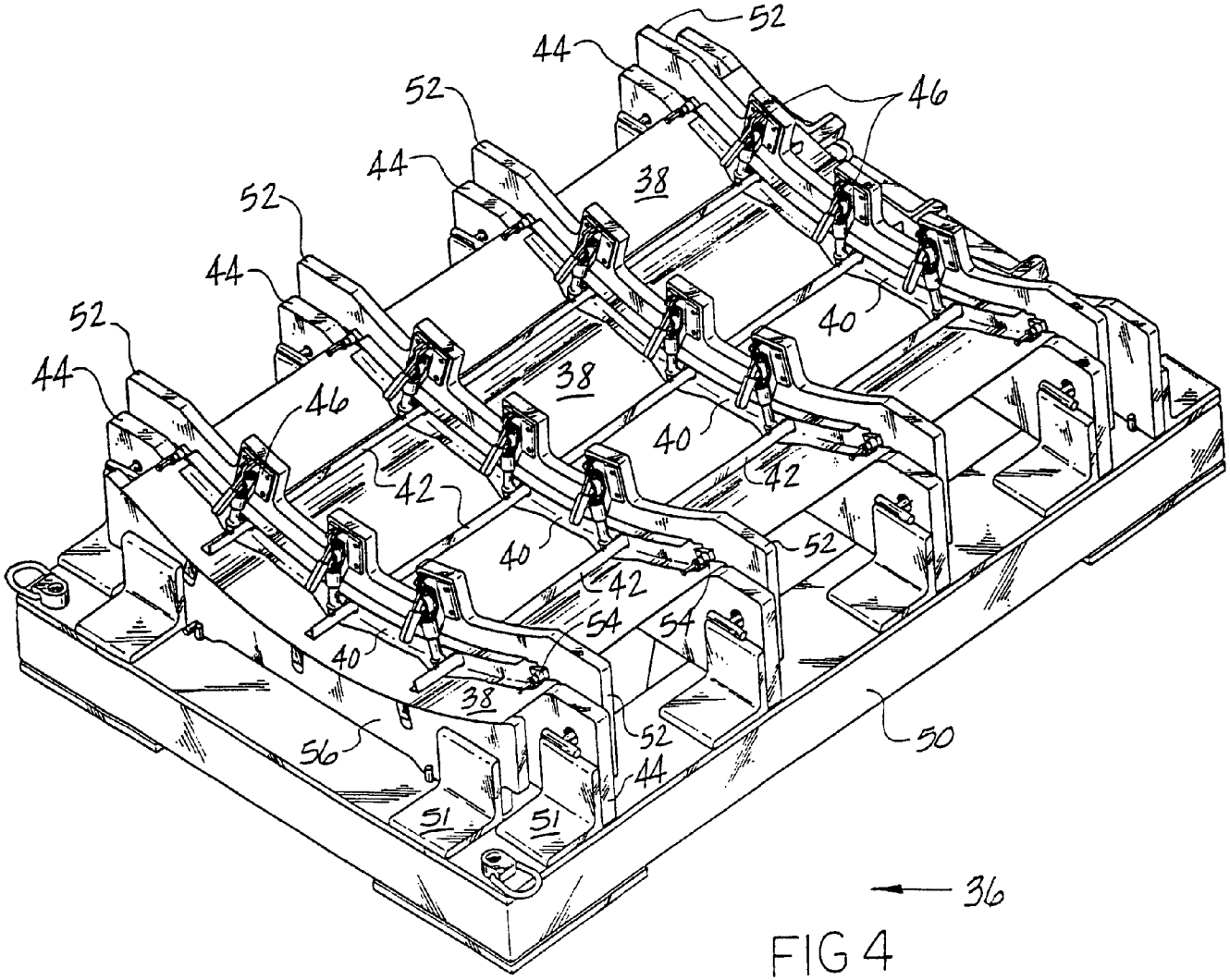
FIG. 4 is a perspective view of the fixed tooling with the skin, C-channels and stringers clamped up for riveting.

The riveting method of the present invention is accomplished through the use of riveting gun 10 shown in FIGS. 1 and 2 in conjunction with fixed tooling generally identified by numeral 36 shown in FIGS. 3 and 4.

The riveting gun 10 is a single impact gun including a housing 11 containing a piston 12 which is concentrically attached to impact pin 13, which in turn drives hammer 30 to upset a back rivet 60, as illustrated in FIG. 2. Rod and hammer guide 26 is integral with sleeve 23 and slides in sleeve 22 which is integral with housing 11. Located on the bottom of hammer guide 26 is a bearing surface 34 for engaging the surface being riveted. Located in spring chamber 16 as shown in FIG. 2 is a coiled compression spring which forces sleeve 23 along with the rod and hammer guide 26 downward against snap ring 21. In both the FIGS. 1 and 2 positions, sleeve 23 is in its fully compressed position with trigger 24 ready to fire when depressed.

The locking mechanism for the rivet gun is accomplished through trigger lockout arm 18 which attaches to sleeve 23 through pin 17, as best seen in FIG. 2 with the upper end of arm 18 pinned to the trigger 24. When the bearing surface 34 of the rivet gun 10 is not pressed against a surface, sleeve 23 engages with snap ring 21 whereby link 18 locks the trigger from firing until the bearing surface 34 of the rivet gun is forced against the surface being riveted and the spring 15 is fully compressed to the position shown in FIG. 2. The structure and circuitry for driving piston 12 against stop 20 is not shown since it is conventional and well known in the pneumatic nail driving art. The basic operation of this rivet gun with the exception of the offset driving hammer 30 is similar to pneumatic nail guns. While the trigger lockout mechanism in nail guns is intended for safety purposes, it is used for a different function with the present invention wherein the force required to unlock the gun when pressed against the surface being riveted is utilized to tightly hold the two members together while the rivet head is upset to provide an optimum strength connection.

The rod and hammer guide 26 illustrated in FIGS. 1 and 2 permits a rivet to be driven off-center from the impact pin 13 of the gun 10 so that C-channels 40, as shown in FIG. 2, can be riveted to skin 39 even though there is an overhanging flange on the C-channel. Rod and hammer guide 26 includes a horizontal slot 28 extending across guide 26 which contains a pivotally mounted hammer 30 attached to guide 26 through pin 32. Before the rivet gun can fire, the bearing surface 34 of the rivet gun must be pressed against the surfaces being riveted with sufficient force to fully compress spring 15 and arm firing trigger 24.

The process just described is a method of back-riveting wherein the upset portion of the rivet is on the inside surface of the aircraft section 59 being fabricated with the bucking bar function being performed by back bars 44 and 48 which are holding countersunk rivets 60 flush with the skin of the aircraft section while the inside end of the rivet is being upset as shown in FIG. 2.

Figure 5:
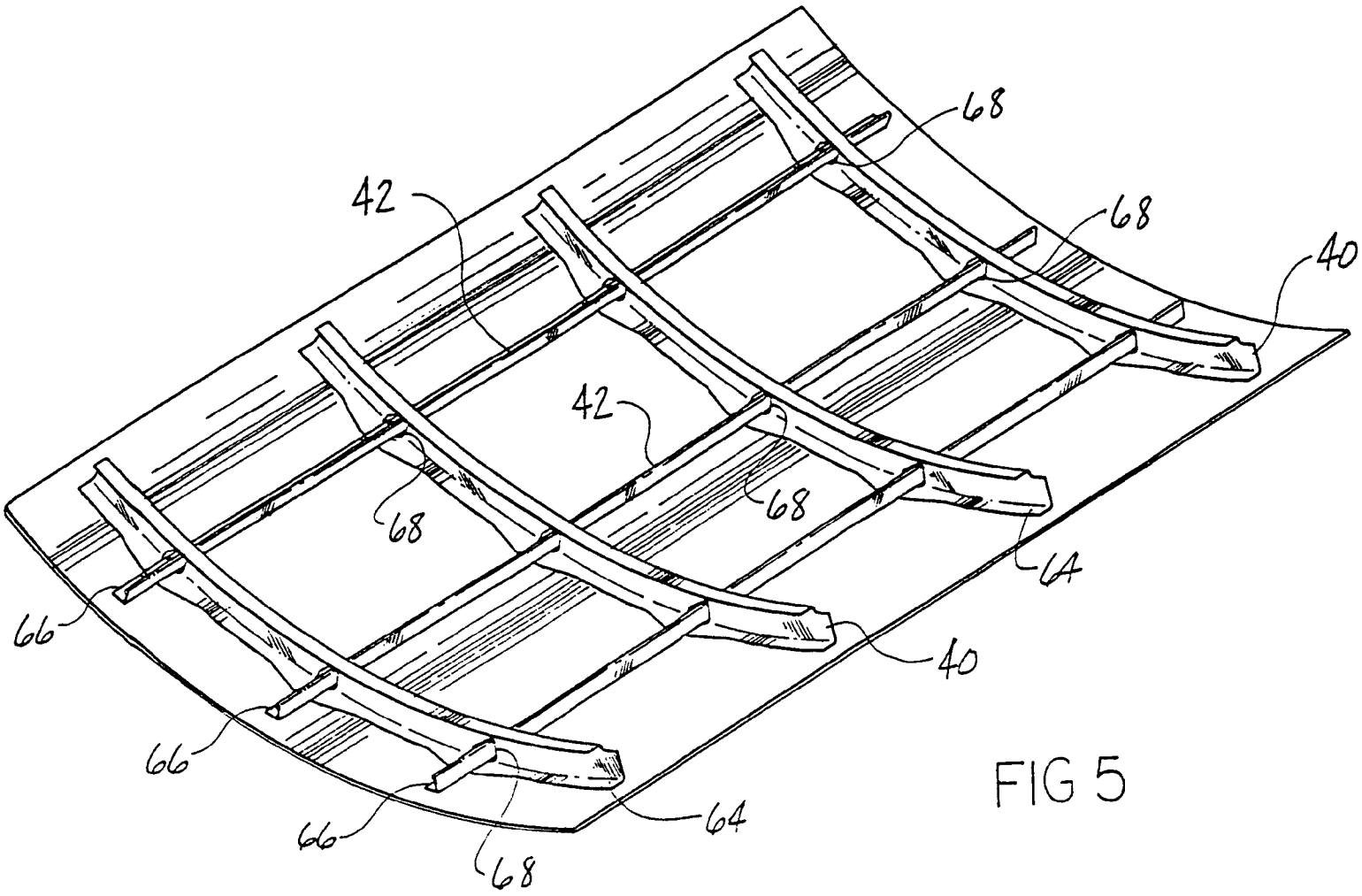
FIG. 5 is a perspective view of a riveted assembled section of aircraft structure removed from the tooling.

The overall stationary tooling, generally represented by reference numeral 36, as shown in FIG. 3, is used to build a section of an aircraft fuselage, as illustrated in FIG. 5. The tooling 36 provides a backup bar function for all of the rivets in the section 59 being constructed. Typical aircraft sections, as shown in FIG. 5, include a series of C-channels 40 or Z-channels 66 spaced longitudinally along the fuselage section while a series of stringers 62 run normal thereto passing through openings 68 and C-channels 40. The lower flange 64 of the C-channel is riveted to the skin 39 on approximately one-inch spacings along the entire length of the flange which are not shown in the drawing. The stringers 62 have an angle cross section with one flange 66 which lies flush with the aircraft skin 39 and is riveted along its full length with a similar spacing to the C-channel rivets.

The stationary tooling 36, as symbolically shown in FIG. 2, is actually an elongated solid bar 44, as shown in FIG. 3, having an arcuate surface which conforms with the curvature of the aircraft section at that particular station. The bar 44, also referred to as back bar surface or bucking bar, mounts to tooling frame 50 through a pair of removable pins 58 at opposite ends of the back bar. When the various parts to be riveted are placed in the tooling 36, as shown in FIG. 4, a series of hold down clamps 46 are utilized to hold the lower flange 64 of the C-channels tightly against the skin 38 so that there is no movement during the riveting operation. Hold down clamps 46 are mounted on hold down bars 52 which are positioned juxtaposed to back bar surfaces 44. Also mounted on hold down bars 52 are series of locator clamps 54 one on each end of bar 52 which holds the web of the C-channels against the bars 52. Positioned normal to the back bars 44 are another set of back bar tooling surfaces 48, as shown in FIG. 3, which provide for the rivets in stringers 42. These back bars 48 pass through opening 68, as shown in FIG. 5, and bars 44 and their tooling surfaces are flush with those in back bars 44.

Located on each end of the tooling section 36, is a secondary pair of arcuate tooling surfaces 56 which support the ends of back bars 48 so there is no deflection of bars 48 during riveting.

FIG. 4 illustrates a section of stationary tooling 36 mounted on a frame 50 with the aircraft skin 38, C-channels 40, and stringers 42 clamped in place and ready for riveting. The rivets 60 have a countersunk flat head which matches a countersunk hole in the skin so that once riveted, they provide a smooth flat surface and once painted cannot be seen. The rivets are held in place in skin 30 prior to upsetting by a thin strip of adhesive tape, not shown, which is removed after riveting.

Due to upsetting the rivets on the back side and the precision amount of upsetting there is no chance for deforming the sheet metal skin due to over driving the rivet. The mechanical stop 20 in gun 10 limits the stroke of impact pin 13 which ensures that the rivets are driven consistently every time and prevents them from being overdriven.

OPERATION

Before the tooling 36 is loaded, the skin 38 is predrilled and countersunk for all the rivet holes and the countersunk rivets are placed in the skin with some type of thin adhesive tape which holds the rivet heads flush with the skin so as to prevent the rivets from falling out. The skin is then placed in the tooling 36 with the rivet heads resting against the back bars 44 and 48. The C-channels 40 are clamped in place both against the tooling back bars 44 as well as against the hold down bars 52 through the action of hold down clamps 46 and locator clamps 54.

Once all the C-channels 40 and stringers 42 are accurately clamped in place, the hand-held riveting gun 10 rivets the various C-channels and stringers to skin 38. The riveting time over conventional riveting is substantially shortened for a variety of reasons, the first being the rivet gun only requires a single impact for each rivet and, secondly, there is no time delay while a second person positions a hand-held bucking bar against each rivet as it is being upset. The bearing surface 34 on the firing end of the rivet gun 10 is placed over the shank of the rivet which is protruding from the sandwiched parts. The operator applies a force to the rivet gun towards the hard tooling surface 36 which will compress internal spring 15 in the rivet gun. When the spring is fully compressed, the trigger automatically unlocks and the operator fires the gun which swells the shank end of the rivet and completes the installation with a single blow. With this system there is no deforming of the sheet material in the skin as the rivet gun impacts the rivet head. The operation of the rivet gun also facilitates the clamp up of the parts in conjunction with the clamps in the tooling which ensures structural integrity between all the parts being riveted. Building the aircraft sections in a precise tooling of this nature increases the dimensional accuracy in alignment of the sections as compared with the prior art methods.

While I have shown and described in considerable detail what is believed to be the preferred forms of the invention, it would be understood by those skilled in the art that the invention is not limited to such details, but might take various other forms within the scope of the following claims.

What is claimed is:

1. A section of aircraft tooling used to construct a section of aircraft structure from skins with countersunk holes in the outer surface, channels, stringers and countersunk rivets comprising:

a stationary frame;

a plurality of arcuate and planar rigid tooling surfaces attached to the frame, the surfaces are shaped to the exterior shape of the aircraft structure and cover all of the rivet heads in the skins of the section being constructed to back the rivets flush with the skin as they are back riveted by a hand-held rivet gun.

2. A section of aircraft tooling, as set forth in claim 1 including clamping members attached to the tooling clamping the skins, channels and stringers in alignment against the tooling surfaces prior to riveting.

* * * * *

UNITED STATES PATENT AND TRADEMARK OFFICE

CERTIFICATE OF CORRECTION

PATENT NO. : 6,961,983 B1
DATED : November 8, 2005
INVENTOR(S) : Joel J. Heck et al.

It is certified that error appears in the above-identified patent and that said Letters Patent is hereby corrected as shown below:

Column 3,
Line 55, should read -- can be riveted to skin 38 even though there is an overhang- --.

Column 4,
Line 9, should read -- as shown in FIG 5, include a series of C-channels 40 and --.
Line 10, should read -- Z-channels 66, also referred to as stringers, spaced longitudinally along the fuselage --.
Line 11, should read -- section while the series of Z-channels 66 run normal thereto --.
Line 13, should read -- flange 64 of the C-channel, as shown in FIG 1, is riveted to the skin 38 on --.
Line 16, should read -- 42 have an angle cross section with one flange 66 wich lies --.
Line 17, should read -- flush with the aircraft skin 38 and is riveted along its full --.
Line 20, should read -- 2, is actually an elongated solid bar 44, as better shown in FIG. 3. --.

Signed and Sealed this

Ninth Day of May, 2006

JON W. DUDAS
*Director of the United States Patent and Trademark Office*